US005960787A

United States Patent [19]

Raleigh et al.

[11] Patent Number: 5,960,787

[45] Date of Patent: Oct. 5, 1999

[54] GAS APPLIANCE COMBUSTION SYSTEMS

[75] Inventors: William F. Raleigh, Santa Clarita; Jack Michael Thompson, Camarillo, both of Calif.

[73] Assignee: Teledyne Industries, Inc., Los Angeles, Calif.

[21] Appl. No.: 08/851,639

[22] Filed: May 6, 1997

[51] Int. Cl.[6] ..... F23J 11/00

[52] U.S. Cl. ..... 126/312; 126/110 R; 126/307 R; 431/114; 110/162

[58] Field of Search ..... 126/110 R, 99 R, 126/116 R, 312, 307 R, 113; 110/162; 454/16; 431/114, 354

[56] References Cited

U.S. PATENT DOCUMENTS

| | | | |
|---|---|---|---|
| 1,406,952 | 2/1922 | Finsterbusch | 110/162 |
| 1,470,187 | 10/1923 | Prat | 110/162 |
| 4,561,421 | 12/1985 | Hwang et al. | 126/110 R |
| 4,762,487 | 8/1988 | Zappa | 431/114 |

OTHER PUBLICATIONS

Fluid Meters, Their Theory and Application ASME—Sixth Edition 1971.

*Primary Examiner*—James C. Yeung

*Attorney, Agent, or Firm*—Benoit Law Corporation

[57] ABSTRACT

Required blower power in an induced draft combustion system is reduced by recovering pressure from dynamic energy of flow of combustion products. To this end, the outlet duct is diverged gradually, such as an included angle of less than fifteen degrees, and preferably at an angle of substantially seven degrees. Divergence of the outlet duct may be expressed in polar coordinates having a polar axis, overlapping radius vectors and a variable polar angle of such overlapping radius vectors relative to the polar axis. A difference between such overlapping radius vectors is increased in a direction of flow of the combustion products and the outlet duct is structured with cross-sections increasing incrementally in terms of the increasing difference between the overlapping radius vectors. Condensate may be drained from a combustion product by providing the duct with a lateral offset having a bottom extending at an angle to the earth's field of gravity. Condensate may be collected at that bottom, and the condensate may be drained from that bottom.

40 Claims, 3 Drawing Sheets

14
65
61
74
62
75
76
77
73
12
81
56
71
43
78
15
72
79
54
11
19
13
16

GAS APPLIANCE COMBUSTION SYSTEMS

FIELD OF THE INVENTION

The subject invention relates to heating systems of a combustion type, including fan-assisted combustion systems, and to gas appliances and components therefor.

BACKGROUND

High efficiency gas-fired combustion appliances usually have so-called fan-assisted combustion systems, wherein a fan or blower is used to move combustion reactants and products through the system. The blower energy can enhance performance of the appliance in several ways. It can enhance mixing of the fuel and air. It can enhance heat transfer by forcing the convective process. It can enhance disposal of the combustion products by moving them out of the appliance through a suitable vent.

A common approach to design of such systems is to use the blower to "pull" the flow through the system. Such an approach is often referred to as induced draft. One advantage of induced draft is that all parts of the system are at negative pressure relative to the atmosphere, and a leak will not result in heat or combustion products escaping into the environment. On the other hand, the blower must handle combustion gases which may be hot and moist.

Suitable components for high efficiency equipment have been produced commercially for several years. However, commonly available blowers have been designed for residential space heating units, which have energy input rates limited to about 150,000 Btu/h. Blowers for equipment of higher input rate are not readily available.

If the appliance is to also have especially good combustion quality, such as very low emission of oxides of nitrogen, it is advantageous to employ a "pre-mix" combustion system, i.e. one in which the air and fuel are mixed completely before reaching the flame zone. Bunsen-type burners, in which only a portion of the necessary air is provided before the flame zone, typically have higher emission of oxides of nitrogen than pre-mix burners.

Effective pre-mixing of fuel and air requires energy, and such energy is in addition to that required to meet the basic flow requirement of the combustion system.

An appliance having high energy input rate and a pre-mix burner would therefore require a combustion blower with considerably more flow and pressure capability than is commonly available for typical furnaces. Since the power requirement of such a blower is proportional to the product of flow and pressure, a blower providing three or four times the flow and two or three times the pressure might easily require five to ten times as much operating power.

In the design of a gas appliance, the flow through the combustion system cannot be reduced significantly. The reactant or fuel gas flow rate must provide the specified energy input rate. Air flow can be no lower than the stoichiometric requirement for oxygen, and in practical combustion systems has to be substantially higher. Therefore, the only way to significantly decrease combustion blower power requirement is to reduce the pressure requirement, requiring careful attention to all dissipative elements, such as heat exchangers, burners or mixing devices.

In very high efficiency appliances, combustion products are cooled below their dew point (about 130° F. or about 54° C., varying with excess air), and liquid water is condensed. This water is somewhat corrosive, and components contacted thereby, such as a combustion blower must be constructed of corrosion-resistant materials. Also, accumulated water must be collected and disposed of by means of suitable drains.

Manufacturers of combustion blowers have developed products providing high flow and pressure by applying high-speed motors to their existing blowers. Typically, a brushless d.c. motor, capable of operating at 5,000 RPM or more is applied to a blower originally intended for operation with 3,000 RPM AC motors.

Operation at such speeds increases the noise produced by the blower. An element of this noise may be the "blade passage" tone, comparable to the slapping noise of a helicopter blade or the whining of a jet engine. In the case of combustion blower systems, annoying tones of this kind are produced by the motion of the tips of the blower blades past a stationary object, such as the cutoff of the blower housing. One available blower has nine blade tips and operates at about 5000 RPM. This results in an audible tone of 45,000 cycles per minute or 750 Hz, which can be very annoying.

SUMMARY OF THE INVENTION

Objects of the invention include singly or in combination:

Reducing required blower power in an induced draft combustion system.

Recovering pressure from dynamic energy of flow of combustion products.

Structuring outlet ducts with bends.

Providing improved condensate draining systems.

Providing improved outlet duct mufflers.

Combinations of such features.

The subject invention resides in a method of reducing required blower power in an induced draft combustion system wherein combustion products are moved through the system by a blower blowing combustion products into an outlet duct. According to this aspect thereof, the invention resides in equipping the combustion system with a venturi system mixing combustible gas with air for combustion resulting in combustion products, inducing a draft into and from that venturi system with the blower, and recovering pressure from dynamic energy of flow of combustion products by gradually diverging the outlet duct.

According to another aspect thereof, the invention resides in a method of recovering pressure from dynamic energy of flow of combustion products in a combustion system wherein combustion products move through the system into an outlet duct. According to this aspect thereof, the invention resides in gradually diverting the outlet duct in terms of polar coordinates having a polar axis, overlapping radius vectors and a variable polar angle of such overlapping radius vectors relative to the polar axis. A difference between such overlapping radius vectors is increased in a direction of flow of the combustion products from a minimum incrementally to a maximum in terms of incremental polar angles, and the outlet duct is structured with cross-sections increasing incrementally, starting at the minimum in terms of the increasing difference between the overlapping radius vectors.

From a related aspect thereof, the invention resides in an induced draft combustion system wherein combustion products are moved through the system by a blower blowing combustion products into an outlet duct, and, more specifically, resides in the improvement comprising a combustible gas and air mixing venturi system, a draw-through system including that venturi system and the blower, and a gradual divergence of the outlet duct, whereby required blower power is reduced by recovery of pressure from dynamic energy of flow of the combustion products.

According to an embodiment of the invention, the divergence of the outlet duct is at an included angle of less than fifteen degrees, and preferably at substantially seven degrees.

From another aspect thereof, the invention resides in a combustion system wherein combustion products move through the system into an outlet duct, and, more specifically, resides in the improvement comprising, in combination, a gradual divergence of said outlet duct in terms of polar coordinates having a polar axis, overlapping radius vectors and a variable polar angle of such overlapping radius vectors relative to the polar axis. A difference between such overlapping radius vectors increasing in a direction of flow of the combustion products from a minimum incrementally to a maximum in terms of incremental polar angles, and the outlet duct having cross-sections increasing incrementally in the direction of flow of combustion products in terms of the increasing difference between the overlapping radius vectors.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figure 1:
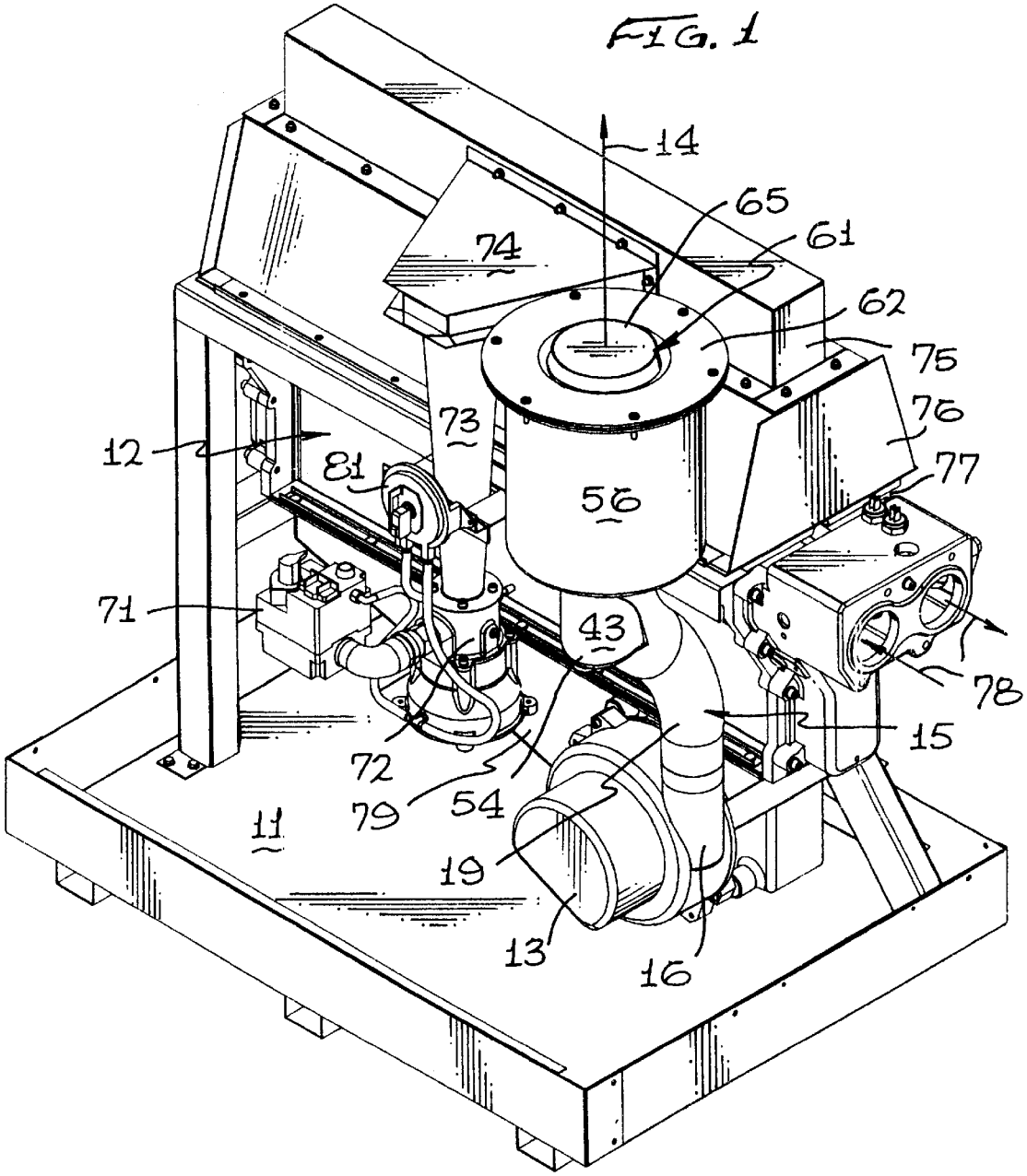
FIG. 1 is a perspective view of an induced draft combustion system having an outlet duct structure according to a preferred embodiment of the invention.

FIG. 1 by way of example shows a gas fired water heater unit 11 having an induced draft combustion system 12 wherein combustion reactants are moved through the system by a fan or blower 13 blowing combustion products 14 through an outlet duct 15.

According to an embodiment of the invention, required fan or blower power is reduced by recovering pressure from the dynamic energy of the flow of combustion products 14 by gradually diverging the outlet duct 15 .In apparatus terms, the system includes a gradual divergence of the outlet duct 15, whereby required blower power is reduced by recovery of pressure from dynamic energy of flow of the combustion products.

Figure 2:
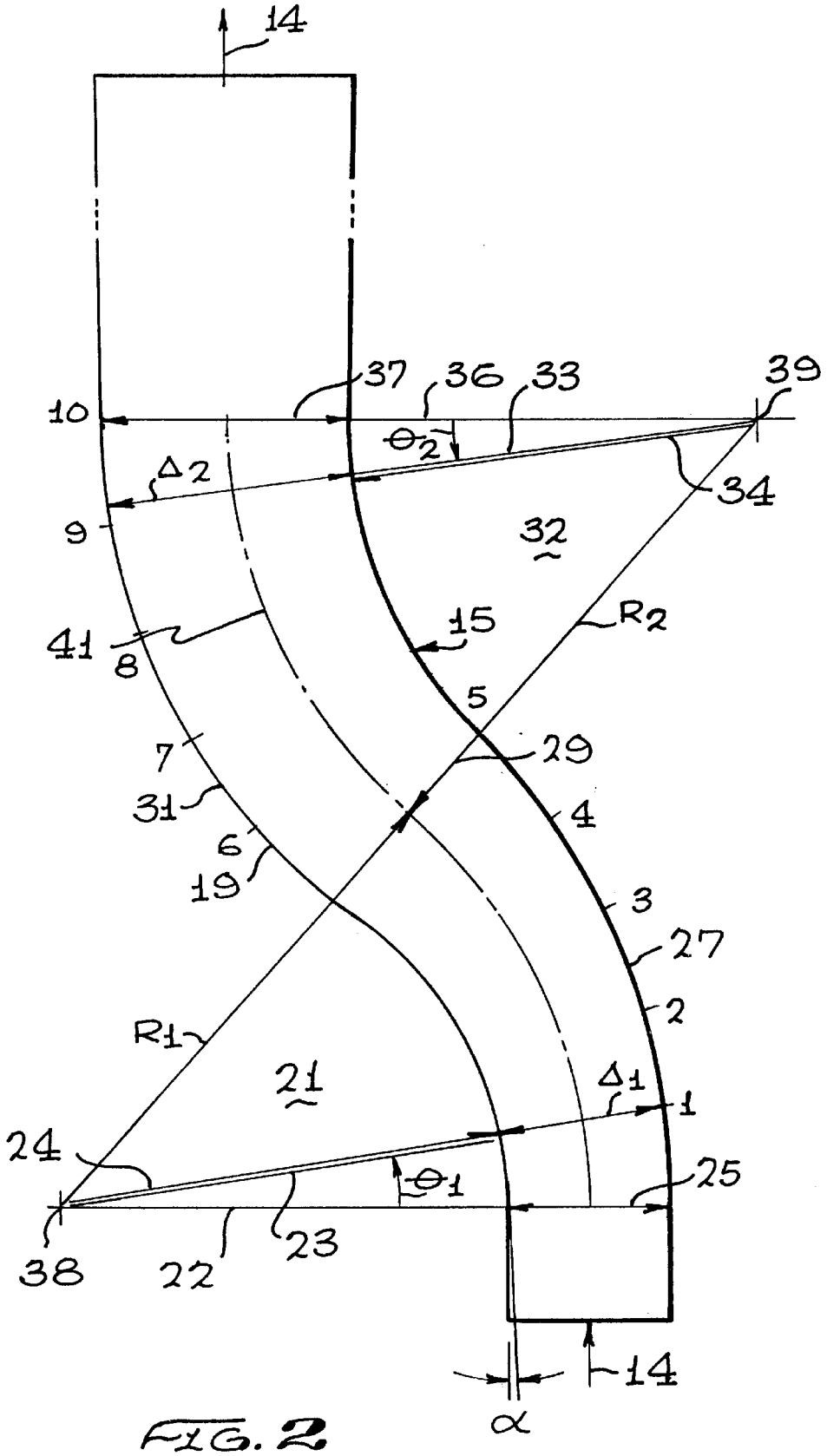
FIG. 2 is a side view of an outlet duct constructed according to an embodiment of the invention.

FIG. 2 in this respect shows an angle $\alpha$ of about 3.5 degrees at one side of the duct 15. The angle of divergence of that outlet duct is $2\alpha$ or substantially seven degrees in this illustrated preferred embodiment of the invention. Smaller and larger angles of divergence are possible within the broad scope of the invention, if a certain turbulence of combustion products 14 can be tolerated, such as for the sake of other advantages. For instance, within the broad scope of the invention, included angles of divergence of more than seven degrees may be imposed on the outlet duct 15 in order to meet practical space limitations, but pressure recovery from the dynamic flow of the combustion product 14 will thereby be correspondingly reduced, requiring more power of the fan or blower 13 than the minimal optimum achievable within the scope of the invention. However, the divergence of the outlet duct 15 should be less than fifteen degrees included angle.

A preferred embodiment of the invention provides a continuous, smooth change in cross-section along the length of the duct. Dimensions are calculated at specific angles, but the true shape is a continuously diverging one with an infinite number of such sections.

Where the outlet 16 of the fan or blower 13 and the exhaust outlet of the unit are not aligned, such as in the water heater unit 11 shown in FIG. 1, a bend, such as the bend 19, accommodates both such non-alignment of outlets and the divergence of the duct passage walls.

Such bend 19 also reduces overall length of the outlet duct 15. Further reduction of the overall length of outlet duct 15 is possible by imposing a gooseneck bend on that duct 15, such as seen in the drawings wherein the bend 19 is composed of oppositely curved bends 27 and 31, by way of example. In this manner, all kind of alignment problems can be solved, and all kind of space limitations can be met without sacrificing optimum pressure recovery and reduction of fan or blower power requirements.

According to an embodiment of the invention, FIG. 2 shows divergence of the outlet duct 15 in terms of polar coordinates. One set 21 of polar coordinates has a polar axis 22, overlapping radius vectors 23 and 24, and a variable polar angle $\theta_1$ of these overlapping radius vectors relative to that polar axis. A difference $\Delta_1$ between overlapping radius vectors 23 and 24 is increased from a minimum near the fan or blower 13, such as at 25, incrementally to a maximum remote from that fan or blower in terms of incremental polar angles. Outlet duct 15 is structured with cross-sections increasing incrementally starting near fan or blower 13 in terms of increasing difference $\Delta_1$ between overlapping radius vectors 23 and 24.

This embodiment of the invention can be used to impose a single bend on the outlet duct, thereby overcoming alignment problems and reducing overall length of that outlet duct while preserving recovery of pressure from dynamic flow energy of the combustion products, such as already mentioned above.

An embodiment of the invention establishes more than one polar coordinate system for shaping and dimensioning the outlet duct 15, such as the two polar coordinate systems 21 and 32 specifically illustrated in FIG. 2 having the outlet duct 15 therebetween. That illustrated embodiment may be characterized as diverging a first part 27 of outlet duct 15 in a first one of the polar coordinate systems, such as in the first coordinate system 21 shown in FIG. 2, in terms of first overlapping radius vectors 23 and 24 and a variable first polar angle $\theta_1$ of such first overlapping radius vectors relative to a first polar axis 22.

This embodiment of the invention may further be characterized by increasing a difference $\Delta_1$ between the first overlapping radius vectors 23 and 24 from a first minimum 25 near fan or blower 13 incrementally to a first maximum 29 at an end of the first part 27 of outlet duct 15 away from fan or blower 13 in terms of incremental first polar angles $\theta_1$.By way of example, FIG. 2, starting at the polar axis 22 with zero (0), indicates increments with numerals 1,2,3,4, and 5, while Table I set forth below lists corresponding incremental polar angles $\theta_1$.

This embodiment of the invention may be further characterized as structuring the first part 27 of outlet duct 15 with cross-sections increasing incrementally, starting near fan or blower 13 or minimum cross-section at 25, in terms of increasing difference $\Delta_1$ between overlapping first radius vectors 23 and 24 to the end 29 of that first part of outlet duct 15.

This embodiment of the invention may be further characterized as diverging a second part 31 of outlet duct 15 in the second polar coordinate system 32 in terms of second overlapping radius vectors 33 and 34 and a variable second polar angle $\theta_2$ of such second overlapping radius vectors relative to a second polar axis 36. A difference $\Delta_2$ between the second overlapping radius vectors 33 and 34 is increased from a second minimum, which is at least as large as the first maximum 29 at the end of the first part 27 of outlet duct 15, incrementally to a second maximum 37 at an end of the second part 31 of outlet duct 15 away from the first part 27 in terms of incremental second polar angles $\theta_2$. It may be noted in this respect that "incremental" is used in an absolute sense irrespective of sign, since the maximum second polar angle starts at increment No. 5, and hence through numerals 6,7,8,9,and 10 to the minimum or zero value of such second polar angle $\theta_2$ at the second polar axis 36, such as seen in Table I set forth below.

Such second part 31 of outlet duct 15 is structured with cross-sections increasing incrementally, starting near end 29 of the first part 27 of outlet duct 15 in terms of increasing differences $\Delta_2$ between overlapping second radius vectors 33 and 34 to the end 37 of the second part 31 of outlet duct 15.

This, without intent of limitation, is exemplified in the following Table I, listing increment numbers (INCR#) from 0 to 10, such as shown in FIG. 2, polar angles $\theta_1$ and $\theta_2$, polar angle increments $\Delta_1$ and $\Delta_2$,internal diameters (I.D.) of duct 15, and duct diameter increments ΔI.D. Of course, internal diameter is indicative of cross-section, such as in terms of $(\text{I.D.}/2)^2\pi$ in the case of circular ducts, or in terms of $\text{I.D.}^2$ etc. in the case of square ducts, and so forth.

TABLE I

| INCR # | $\theta_1$ | $\Delta\theta_1$ | $\theta_2$ | $\Delta\theta_2$ | I.D | ΔI.D. |
|---|---|---|---|---|---|---|
| 0 | 0° | 9.45° | — | | 2.20"(≈56 mm) | |
| 1 | 9.45° | 9.46° | — | | 2.31 | .12 |
| 2 | 18.91° | 9.45° | — | | 2.43 | .11 |
| 3 | 28.36° | 9.45° | — | | 2.54 | .11 |
| 4 | 37.81° | 9.46° | — | | 2.65 | .11 |
| 5 | 47.27° | | 47.27° | 9.46° | 2.76 | .13 |
| 6 | — | | 37.81° | 9.45° | 2.89 | .10 |
| 7 | — | | 28.36° | 9.45° | 2.99 | .12 |
| 8 | — | | 18.91° | 9.46° | 3.11 | .11 |
| 9 | — | | 9.45° | 9.45° | 3.22 | .11 ≈2.8 mm |
| 10 | — | | 0° | | 3.33 | |

Useful polar angle increments $\Delta\theta_{1or2}$ may be derived in any polar system 21 or 32 from the range of the polar angles $\theta_1$ or $\theta_2$ expressed as $\Delta\Sigma\theta_{1or2}$. Useful duct diameter increments ΔI.D. may be derived from a difference between maximum and minimum diameters or cross-sections $\Delta\Sigma_{ID}$, such as between the maximum diameter or cross-section at 37 near an end of the duct 15 and the minimum diameter or cross-section at 25 near a beginning of that outlet duct 15 near the fan or blower 13. This may be expressed in the following equations:

$$\Delta\Sigma\theta_{1or2} = \frac{47.27°}{5INCR} = 9.454° \quad \Delta\Sigma_{ID} = \frac{1.13''}{10INCR} = 0.113$$

The increments preferably should all be identical except for round-offs.

The duct 15 in FIG. 2 is structured in terms of radii $R_1$ and $R_2$ pivoted at the origins 38 and 39 of the polar coordinate systems 21 and 32. Such radii, indeed, may determine the loci of the S-curved central axis 41 of the gooseneck-shaped duct 15. However, the invention is not so limited, as the cross-sectional incremental dimensions $\Delta_1$ and $\Delta_2$ may be realized in other ways within the scope of the invention or even within the scope of Table I, with the axis 41 being not necessarily circular in nature, but rather may follow another type of curve or a straight line, or a compound of straight and curved lines.

Depending on desired performance or type of application, the increments may be coarser than as shown in FIG. 2 or they may be finer to the point of being practically infinitesimal.

Aspects of the invention are of independent utility. For example, according to another aspect thereof, the invention resides in a combustion system wherein combustion products 14 move through the system into an outlet duct 15. According to this aspect, an embodiment of the invention resides in a method of recovering pressure from dynamic energy of flow of the combustion products by diverging the outlet duct 15 in terms of polar coordinates, such as shown at 21 in FIG. 2, having a polar axis 22, overlapping radius vectors 23 and 24, and a variable polar angle $\theta_1$ of these overlapping radius vectors relative to that polar axis.

A difference $\Delta_1$ between such overlapping radius vectors 23 and 24 is increased in a direction of flow of the combustion products 14 from a minimum, such as at the bottom of FIG. 2, incrementally to a maximum, such as at 29, in terms of incremental polar angles. The outlet duct 15 is structured with cross-sections increasing incrementally, starting at the minimum in terms of the increasing difference between the overlapping radius vectors 23 and 24. This embodiment of the invention can be used to impose a single bend on the outlet duct 15, such as the lower bend 27 or the upper bend 31 shown in FIG. 2.

In apparatus terms, an embodiment of the currently disclosed aspect of the invention resides in an induced draft combustion system wherein combustion products 14 move through the system into an outlet duct 15 that has a divergence expressed in polar coordinates, such as shown at 21, having a polar axis 22, overlapping radius vectors 23 and 24 and a variable polar angle $\theta_1$ of such overlapping radius vectors relative to that polar axis. A difference between such overlapping radius vectors increases in a direction of flow of the combustion products 14 from a minimum, such as at the bottom of FIG. 2, incrementally to a maximum, such as at 29, in terms of incremental polar angles, and the outlet duct has cross-sections increasing incrementally in the direction of flow of combustion products 14 in terms of the increasing difference between the overlapping radius vectors.

The features herein disclosed for making double bends or gooseneck structures, such as according to FIG. 2 or Table I, may also be applied to these currently disclosed aspects of the invention.

According to another aspect of the invention, condensate may be drained from combustion products 14. While this may be applied to systems other than the ones shown, FIGS. 1 and 3 depict examples of such condensate draining feature or system 43.

Figure 3:
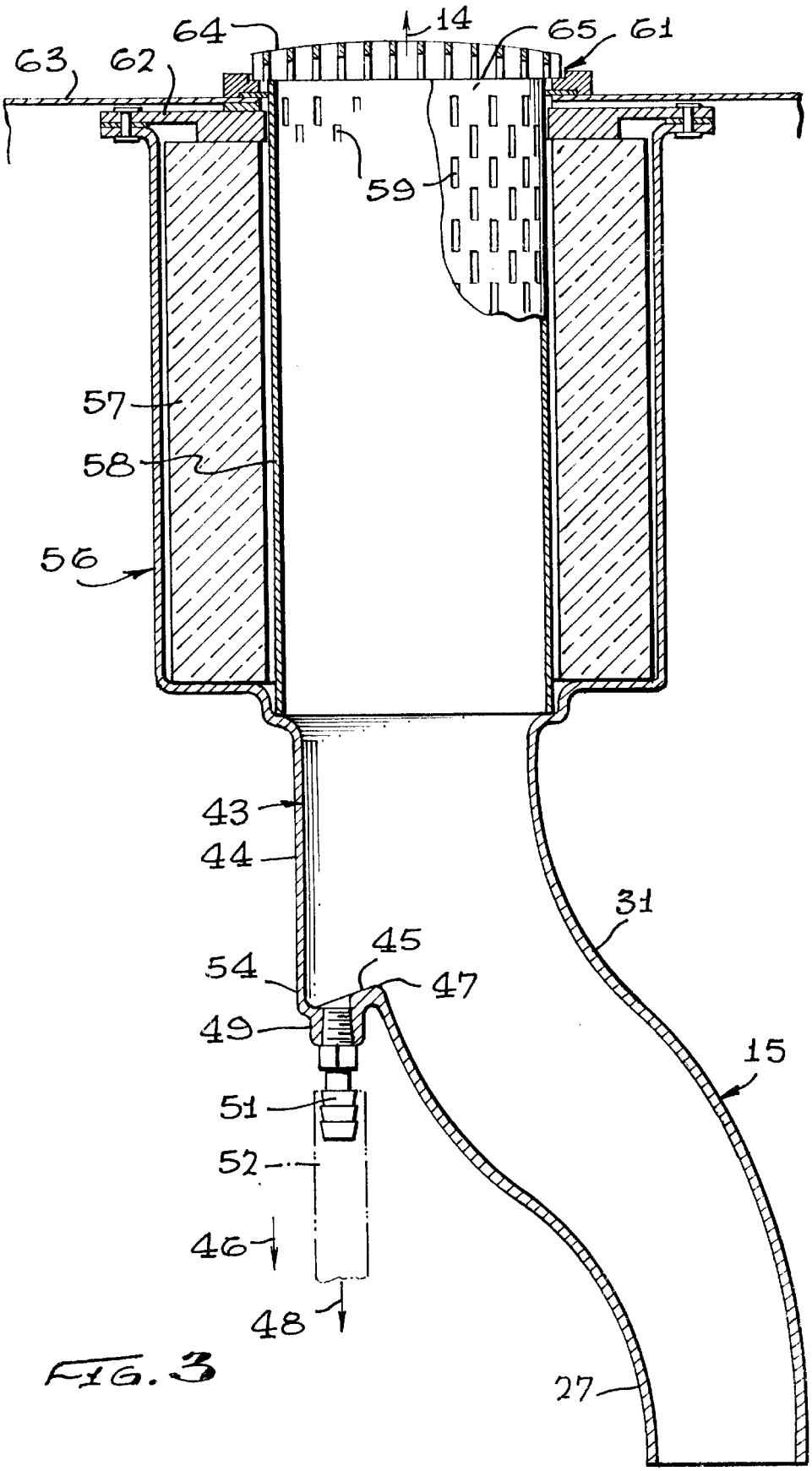
FIG. 3 is a sectional view of an exhaust assembly including an outlet duct of the type shown in FIG. 1, a condensate drain and a muffler exhaust structure according to embodiments of the invention.

In this respect, FIG. 3 shows provision of duct 15 with a lateral offset 44 having a bottom 45 extending at an angle to the earth's field of gravity 46. Such bottom may extend at right angles to the earth's field of gravity 46. Within the scope of this invention, it may be said that the bottom 45 extends at an angle to the earth's field of gravity, which need not necessarily be a right angle.

As seen in FIG. 3 the bottom 45 is sloped downwardly, or has a downward slope to the earth's field of gravity, from a high point 47 in the duct 15 so that the condensate does not run back into the duct.

Condensate 48 is collected at bottom 45 and is drained from duct 15 at or from such bottom 45, such as through a condensate outlet or drain 49. Plastic or other tubing, such as shown in FIG. 3 at 51 and 52, may be used to conduct drained condensate 48 out of the system or unit 11.

In apparatus terms, the duct 15 has a lateral offset 44 having a bottom 45 extending at an angle to the earth's field of gravity 46, and a condensate drain 49, in that bottom of the offset.

As illustrated in FIG. 3, the duct is given or has a change in cross-section at the offset 44 and an angle to the earth's field of gravity 46.

According to the embodiment shown in FIGS. 1 and 3, duct 15 is provided with a projecting heel 54 having a heel bottom as the above mentioned bottom 45 extending at an angle to the earth's field of gravity 46.

As mentioned above under Background, annoying tones frequently occur in fan-assisted combustion systems, which may be part of the noise produced by blower blades and blown combustion products moving past a blower housing cutoff. Other noises from combustion products are also known. An embodiment of the invention muffles such noises which may include tones that, as mentioned above, may have a frequency of some 45,000 cycles per minute or 750 Hz.

According to embodiments of the invention, such tones are muffled with dissipative sound absorptive materials or the duct may otherwise include dissipative sound absorptive materials, such as shown in FIG. 3.

By way of example, the duct 15 may be provided with a muffler housing 56 at its outlet. According to FIG. 3 such muffler housing may be lined with dissipative sound absorptive material, such as fiberglass 57. Such sound insulation 57 may be disposed between a central outlet top pipe 58 and the outer wall of the muffler housing 56. In practice, such outlet top pipe 58 may be laterally apertured or be in the form of a hollow-cylindrical lattice 59.

FIG. 3 also shows an exhaust top structure 61 for the system 11 or for any other combustion system wherein combustion products 14 are exhausted through a system outlet with or without a vent pipe.

According to an embodiment of the invention, the exhaust top 61 includes a flange assembly 62 at which portions of a housing 63 of the unit 11 may be clamped at a housing opening for the exhaust, such as seen in FIG. 3.

A combustion exhaust grille 64 may be installed over the outlet opening 65, such as shown in FIG. 3, primarily for outdoor use of the heater unit 11. Such grille 64 may be removed for interconnection of the exhaust outlet opening with a vent pipe assembly (not shown) primarily for indoor use of the unit 11.

The remainder of the system may be conventional. By way of example, FIG. 1 shows a gas valve or control 71 that may be of a conventional type and that may be connected to a gas pipe or other source of combustible gas (not shown). A venturi or other fluid admixing system 72 mixes the combustible gas with air and supplies such admixture via a tail pipe 73 and conduit chamber 74 to the plenum of a burner assembly 75 for combustion in a combustion chamber 76 followed by a heat exchanger assembly 77.

Such heat exchanger assembly may be of a conventional type wherein the products of combustion from the combustion chamber exchange heat with water or another desired fluid 78 that is conducted to and from the heat exchanger, such as indicated in FIG. 1. A component 81 is indicative of a variety of controls that can be used in the heater. Such controls are conventional technology in the gas-fired heater art.

After traversing the heat exchanger, products of combustion are collected in an exhaust chamber 79 for exhaust through the duct system 15. Those skilled in the art will recognize that the appliance 11 shown in FIG. 1 is a draw-through system wherein an exhaust fan or blower 13 induces a draft into and from the venturi 72 through the system 12 and effects a removal of the combustion products 14. However, the scope of the invention is not so limited. Rather, various aspects of the invention may extend to systems other than those specifically shown herein.

As those skilled in the art may appreciate, the invention has wide ranging utility, with heating of water for hydronics, spas and swimming pools being just an example.

This extensive disclosure will render apparent or suggest to those skilled in the art various modifications and variations within the spirit and scope of the invention.

We claim:

1. A method of reducing required blower power in an induced draft combustion system wherein combustion products are moved through the system by a blower blowing combustion products into an outlet duct, comprising:

equipping said combustion system with a venturi system mixing combustible gas with air for combustion resulting in said combustion products;

inducing a draft into and from said venturi system with said blower; and recovering pressure from dynamic energy of flow of said combustion products by gradually diverging said outlet duct.

2. A method as in claim 1, wherein:

said outlet duct is diverged at an angle of less than fifteen degrees.

3. A method as in claim 2, wherein:

said included angle substantially is seven degrees.

4. A method as in claim 1, including:

providing said duct with a lateral offset having a bottom extending at an angle to the earth's field of gravity;

collecting condensate from said combustion products at said bottom; and draining said condensate from said bottom.

5. A method as in claim 4, wherein:

said duct is given a change in cross-section to provide said offset at an angle to the earth's field of gravity.

6. A method as in claim 4, wherein:

said bottom is sloped downwardly from a high point in said duct.

7. A method as in claim 4, wherein:

said duct is provided with a projecting heel having a heel bottom as said bottom extending at an angle to the earth's field of gravity.

8. A method as in claim 1, including:

muffling a noise from said combustion products.

9. A method as in claim 8, wherein:

said noise is muffled with dissipative sound absorptive material.

10. A method of reducing required blower power in an induced draft combustion system wherein combustion products are moved through the system by a blower blowing combustion products into an outlet duct, comprising:

recovering pressure from dynamic energy of flow of said combustion products by gradually diverging said outlet duct; and reducing overall length of said duct by imposing a bend on said duct.

11. A method as in claim 10, wherein:

overall length of said duct is reduced by imposing said bend as a gooseneck bend on said duct.

12. A method of reducing required blower power in an induced draft combustion system wherein combustion products are moved through the system by a blower blowing combustion products into an outlet duct, comprising:

recovering pressure from dynamic energy of flow of said combustion products by gradually diverging said outlet duct in terms of polar coordinates having a polar axis, overlapping radius vectors and a variable polar angle of said overlapping radius vectors relative to said polar axis;

increasing a difference between said overlapping radius vectors from a minimum near said blower incrementally to a maximum remote from said blower in terms of incremental polar angles; and structuring said outlet duct with cross-sections increasing incrementally starting near said blower in terms of said increasing difference between said overlapping radius vectors.

13. A method of reducing required blower power in an induced draft combustion system wherein combustion products are moved through the system by a blower blowing combustion products into an outlet duct, comprising:

recovering pressure from dynamic energy of flow of said combustion products by gradually diverging said outlet duct by:

establishing more than one polar coordinate system having said outlet duct therebetween;

diverging a first part of said outlet duct in a first one of said polar coordinate systems in terms of first overlapping radius vectors and a variable first polar angle of said first overlapping radius vectors relative to a first polar axis;

increasing a difference between said first overlapping radius vectors from a first minimum near said blower incrementally to a first maximum at an end of said first part of said outlet duct away from said blower in terms of incremental first polar angles;

structuring said first part of said outlet duct with cross-sections increasing incrementally starting near said blower in terms of said increasing difference between said overlapping first radius vectors to said end of the first part of said outlet duct;

diverging a second part of said outlet duct in a second polar coordinate system by second overlapping radius vectors and a variable second polar angle of said second overlapping radius vectors relative to a second polar axis;

increasing a difference between said second overlapping radius vectors from a second minimum at least as large as said first maximum at said end of the first part of said outlet duct incrementally to a second maximum at an end of said second part of said outlet duct away from said first part in terms of incremental second polar angles;

structuring said second part of said outlet duct with cross-sections increasing incrementally starting near said end of said first part of said outlet duct in terms of said increasing difference between said overlapping second radius vectors to said end of the second part of said outlet duct.

14. A method of recovering pressure from dynamic energy of flow of combustion products in a combustion system wherein combustion products move through the system into an outlet duct, comprising in combination:

diverging said outlet duct in terms of polar coordinates having a polar axis, overlapping radius vectors and a variable polar angle of said overlapping radius vectors relative to said polar axis;

increasing a difference between said overlapping radius vectors in a direction of flow of said combustion products from a minimum incrementally to a maximum in terms of incremental polar angles; and structuring said outlet duct with cross-sections increasing incrementally starting at said minimum in terms of said increasing difference between said overlapping radius vectors.

15. A method as in claim 14, including:

establishing more than one polar coordinate system having said outlet duct therebetween;

diverging a first part of said outlet duct in a first one of said polar coordinate systems in terms of first overlapping radius vectors and a variable first polar angle of said first overlapping radius vectors relative to a first polar axis;

increasing a difference between said first overlapping radius vectors in a direction of flow of said combustion products from a first minimum incrementally to a first maximum at an end of said first part of said outlet duct in terms of incremental first polar angles;

structuring said first part of said outlet duct with cross-sections increasing incrementally starting at said minimum in terms of said increasing difference between said overlapping first radius vectors to said end of the first part of said outlet duct;

diverging a second part of said outlet duct in a second polar coordinate system in terms of second overlapping radius vectors and a variable second polar angle of said second overlapping radius vectors relative to a second polar axis;

increasing a difference between said second overlapping radius vectors from a second minimum at least as large as said first maximum at said end of the first part of said outlet duct incrementally to a second maximum at an end of said second part of said outlet duct away from said first part in terms of incremental second polar angles;

structuring said second part of said outlet duct with cross-sections increasing incrementally starting near said end of said first part of said outlet duct in terms of said increasing difference between said overlapping second radius vectors to said end of the second part of said outlet duct.

16. A method as in claim 14, including:

providing said duct with a lateral offset having a bottom extending at an angle to the earth's field of gravity;

collecting condensate from said combustion products at said bottom; and draining said condensate from said bottom.

17. A method as in claim 16, wherein:

said duct is given a change in cross-section to provide said offset at an angle to the earth's field of gravity.

18. A method as in claim 16, wherein:

said bottom is sloped downwardly from a high point in said duct.

19. A method as in claim 16, wherein:

said duct is provided with a projecting heel having a heel bottom as said bottom extending at an angle to the earth's field of gravity.

20. A method as in claim 14, including:

muffling a noise from said combustion products.

21. A method as in claim 20, wherein:

said noise is muffled with dissipative sound absorptive material.

22. In an induced draft combustion system wherein combustion products are moved through the system by a blower blowing combustion products into an outlet duct, the improvement comprising a combustible gas and air mixing venturi system, a draw-through system including said venturi system and said blower, and a gradual divergence of said outlet duct, whereby required blower power is reduced by recovery of pressure from dynamic energy of flow of said combustion products.

23. A system as in claim 22, wherein:

said outlet duct diverges at an included angle of less than fifteen degrees.

24. A system as in claim 23, wherein:

said included angle substantially is seven degrees.

25. A system as in claim 22, wherein:

said duct has a lateral offset having a bottom extending at an angle to the earth's field of gravity; and a condensate drain in said bottom of the offset.

26. A system as in claim 25, wherein:

said duct has a change in cross-section at said offset at an angle to the earth's field of gravity.

27. A system as in claim 25, wherein:

said bottom has a downward slope from a high point in said duct.

28. A system as in claim 25, wherein:

said duct has a projecting heel having a heel bottom as said bottom extending at an angle to the earth's field of gravity.

29. A system as in claim 22, including:

a noise muffler on said outlet duct.

30. A system as in claim 22, wherein:

said duct includes dissipative sound absorptive material.

31. In an induced draft combustion system wherein combustion products are moved through the system by a blower blowing combustion products into an outlet duct, the improvement comprising a gradual divergence of said outlet duct, whereby required blower power is reduced by recovery of pressure from dynamic energy of flow of said combustion products; and a bend in said duct whereby overall length of said duct is reduced.

32. A system as in claim 31, wherein:

said bend is a gooseneck bend in said duct.

33. In an induced draft combustion system wherein combustion products are moved through the system by a blower blowing combustion products into an outlet duct, the improvement comprising a gradual divergence of said outlet duct in terms of polar coordinates having a polar axis, overlapping radius vectors and a variable polar angle of said overlapping radius vectors relative to said polar axis, whereby required blower power is reduced by recovery of pressure from dynamic energy of flow of said combustion products;

a difference between said overlapping radius vectors increasing from a minimum near said blower incrementally to a maximum remote from said blower in terms of incremental polar angles; and said outlet duct having cross-sections increasing incrementally starting near said blower in terms of said increasing difference between said overlapping radius vectors.

34. In a combustion system wherein combustion products move through the system into an outlet duct, the improvement comprising in combination:

a divergence of said outlet duct in terms of polar coordinates having a polar axis, overlapping radius vectors and a variable polar angle of said overlapping radius vectors relative to said polar axis;

a difference between said overlapping radius vectors increasing in a direction of flow of said combustion products from a minimum incrementally to a maximum in terms of incremental polar angles; and said outlet duct having cross-sections increasing incrementally in said direction of flow of said combustion products in terms of said increasing difference between said overlapping radius vectors.

35. A system as in claim 34, wherein:

said duct has a lateral offset having a bottom extending at an angle to the earth's field of gravity; and a condensate drain in said bottom of the offset.

36. A system as in claim 35, wherein:

said duct has a change in cross-section at said offset at an angle to the earth's field of gravity.

37. A system as in claim 35, wherein:

said bottom has a downward slope from a high point in said duct.

38. A system as in claim 35, wherein:

said duct has a projecting heel having a heel bottom as said bottom extending at an angle to the earth's field of gravity.

39. A system as in claim 34, including:

a noise muffler on said outlet duct.

40. A system as in claim 34, wherein:

said duct includes dissipative sound absorptive material.

* * * * *